US010948233B2

(12) United States Patent
Hakata et al.

(10) Patent No.: US 10,948,233 B2
(45) Date of Patent: Mar. 16, 2021

(54) DRYING SYSTEM

(71) Applicant: TRINITY INDUSTRIAL CORPORATION, Toyota (JP)

(72) Inventors: Manabu Hakata, Toyota (JP); Yasushi Kondo, Okazaki (JP); Keiichi Suzuki, Toyota (JP); Kimihiko Sugiura, Toyoake (JP); Satoshi Tamura, Toyoake (JP)

(73) Assignee: TRINITY INDUSTRIAL CORPORATION, Toyota (JP)

( * ) Notice: Subject to any disclaimer, the term of this patent is extended or adjusted under 35 U.S.C. 154(b) by 40 days.

(21) Appl. No.: 16/491,390

(22) PCT Filed: Nov. 6, 2017

(86) PCT No.: PCT/JP2017/039906
§ 371 (c)(1),
(2) Date: Sep. 5, 2019

(87) PCT Pub. No.: WO2018/173351
PCT Pub. Date: Sep. 27, 2018

(65) Prior Publication Data

US 2020/0033058 A1 Jan. 30, 2020

(30) Foreign Application Priority Data

Mar. 21, 2017 (JP) ..... JP2017-054016

(51) Int. Cl.
*F26B 21/00* (2006.01)
*F26B 21/02* (2006.01)
*F26B 3/04* (2006.01)

(52) U.S. Cl.
CPC ..... *F26B 21/004* (2013.01); *F26B 3/04* (2013.01); *F26B 21/028* (2013.01)

(58) Field of Classification Search
CPC ..... F26B 21/004; F26B 21/028; F26B 3/04
(Continued)

(56) References Cited

U.S. PATENT DOCUMENTS 5,657,555 A * 8/1997 Milojevic ..... F26B 3/283 34/271
6,062,850 A 5/2000 Ino et al.
(Continued)

FOREIGN PATENT DOCUMENTS

CN 103189702 A 7/2013
CN 103240196 A 8/2013
(Continued)

OTHER PUBLICATIONS

Feb. 6, 2018 Search Report issued in International Patent Application No. PCT/JP2017/039906.
(Continued)

*Primary Examiner* — Stephen M Gravini
(74) *Attorney, Agent, or Firm* — Oliff PLC

(57) ABSTRACT

A drying system includes a nozzle attached to an air supply duct of a drying chamber that blows out heated air inside the duct toward an object to be dried inside the chamber. The nozzle includes a horn-shaped inner-side surface made of pairs of first and second inner-side surfaces that respectively face each other in first and second directions, an opening width of the second surfaces in the second direction gradually increasing forward in a direction in which the air is blown and being 2 to 25 times inclusive larger than an opening width in the first direction. The drying system includes: the duct with the nozzles; a feeding device feeding air to the duct; and a heating device heats the fed air. The feeding device feeds air to the duct such that the air blown out from the nozzle spreads more in the first direction than in the second.

6 Claims, 13 Drawing Sheets

(58) Field of Classification Search
USPC ..... 34/638
See application file for complete search history.

(56) References Cited

U.S. PATENT DOCUMENTS

| | | | | |
|---|---|---|---|---|
| 10,605,529 | B2 * | 3/2020 | Wieland | F26B 15/14 |
| 10,697,702 | B2 * | 6/2020 | Iglauer | F26B 15/16 |
| 2003/0132223 | A1 | 7/2003 | Ueno | |
| 2019/0283066 | A1 * | 9/2019 | Rauser | F26B 21/10 |
| 2019/0316842 | A1 * | 10/2019 | Moll | F26B 21/10 |
| 2020/0033058 | A1 * | 1/2020 | Hakata | F26B 21/004 |
| 2020/0079328 | A1 * | 3/2020 | Stephens, Jr. | G10K 11/168 |
| 2020/0284510 | A1 * | 9/2020 | Iglauer | F26B 15/16 |
| 2020/0391221 | A1 * | 12/2020 | Schmit | F26B 9/063 |

FOREIGN PATENT DOCUMENTS

| | | | | |
|---|---|---|---|---|
| CN | 104524971 | A | 4/2015 | |
| CN | 105442159 | A | 3/2016 | |
| CN | 105772434 | A | 7/2016 | |
| DE | 102015214711 | A1 * | 2/2017 | F26B 15/14 |
| JP | S49-114877 | U | 10/1974 | |
| JP | S61-145296 | U | 9/1986 | |
| JP | H01-017036 | Y2 | 5/1989 | |
| JP | 2505564 | B2 | 6/1996 | |
| JP | H11-221513 | A | 8/1999 | |
| JP | 2001-321712 | A | 11/2001 | |
| JP | 2001-347933 | A | 12/2001 | |
| JP | 2013-139962 | A | 7/2013 | |
| JP | 2018155463 | A * | 10/2018 | F26B 3/04 |
| KR | 10-0789525 | B1 | 12/2007 | |
| WO | 2015/189087 | A1 | 12/2015 | |
| WO | WO-2017021326 | A1 * | 2/2017 | F26B 15/16 |
| WO | WO-2018173351 | A1 * | 9/2018 | F26B 3/04 |

OTHER PUBLICATIONS

Sep. 24, 2019 International Preliminary Report on Patentability issued in International Patent Application No. PCT/JP2017/039906.
May 28, 2020 Office Action issued in Chinese Patent Application No. 201780088067.7.
Jan. 13, 2021 Office Action issued in Chinese Patent Application No. 201780088067.7.

* cited by examiner

DRYING SYSTEM

TECHNICAL FIELD

The present invention relates to a nozzle attached to an air supply duct of a drying chamber for blowing out heated air inside the air supply duct toward an object to be dried in the drying chamber, and to a drying system equipped with such a nozzle.

BACKGROUND ART

Conical nozzles reducing in diameter toward the distal end have been known as one type of such nozzles (see, for example, Patent Literature 1).

RELATED ART DOCUMENTS

Patent Documents

Patent document 1: Japanese Unexamined Patent Application Publication No. 2001-321712 A (FIG. 1 and paragraph [0016])

DISCLOSURE OF THE INVENTION

Problems to be Solved by the Invention

With the conventional nozzle mentioned above, it takes a long time to dry the entire object to be dried and therefore fuel efficiency was poor.

The present invention was made in view of the circumstance noted above and it is an object of the invention to provide a nozzle capable of drying an object to be dried efficiently in its entirety, and a drying system.

Means of Solving the Problems

The drying system according to one aspect of the present invention devised to achieve the above-noted object is a drying system that includes a nozzle attached to an air supply duct of a drying chamber that blows out heated air inside the air supply duct toward an object to be dried inside the drying chamber. The nozzle includes a horn-shaped inner-side surface made up of a pair of first inner-side surfaces facing each other in a first direction, and a pair of second inner-side surfaces facing each other in a second direction perpendicular to the first direction, with an opening width at least in the second direction gradually increasing forward in a direction in which the air is blown, and the opening width in the second direction being 2 to 25 times inclusive larger than an opening width in the first direction. The drying system further includes the air supply duct including a plurality of the nozzles; a feeding device that feeds air to the air supply duct; and a heating device that heats air fed to the air supply duct, and wherein the feeding device feeds air to the air supply duct in such a flow volume that the air blown out from the nozzle spreads more in the first direction than in the second direction.

MODE FOR CARRYING OUT THE INVENTION

First Embodiment

Figure 1:
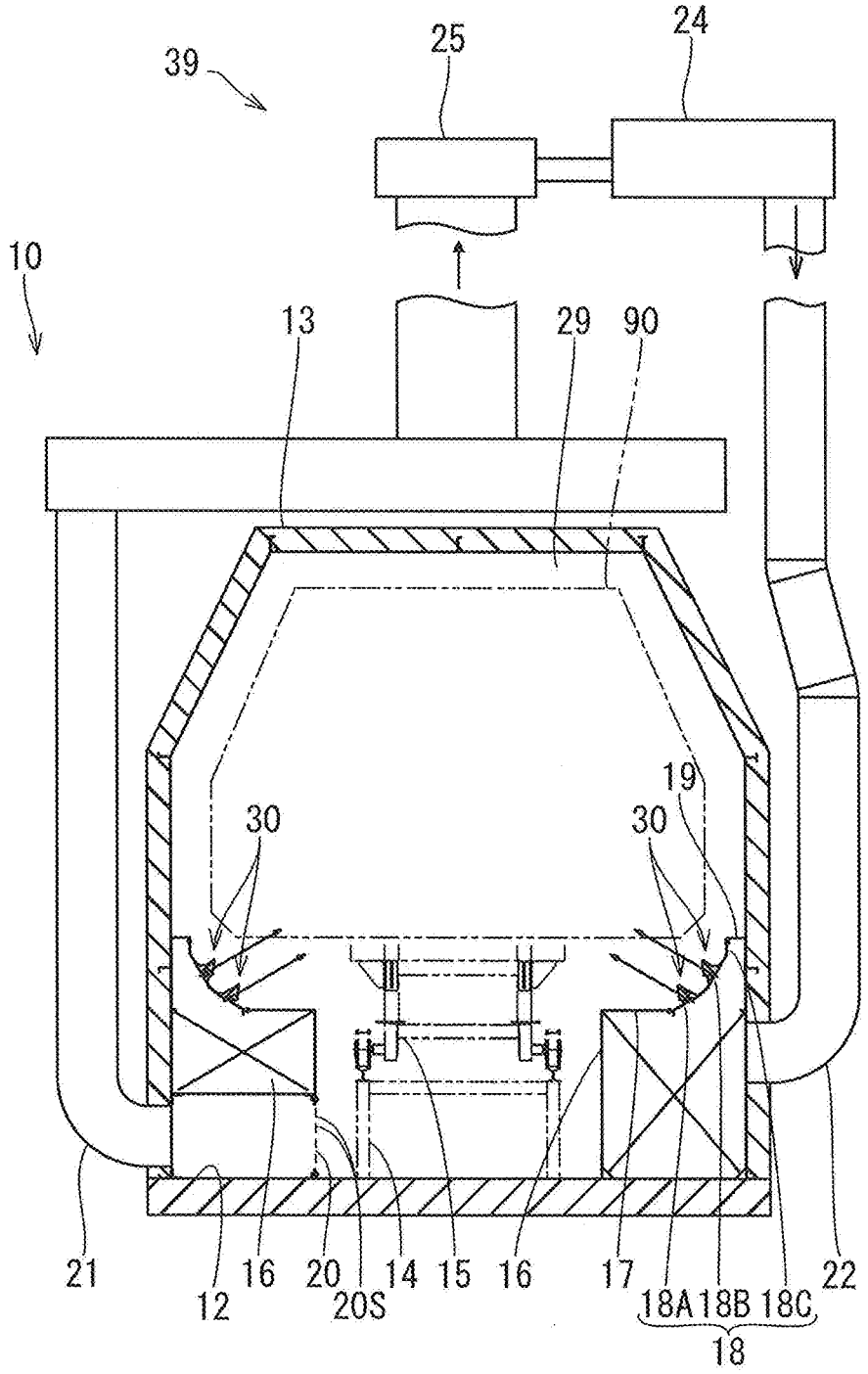
FIG. 1 is a cross-sectional side view of a drying booth according to a first embodiment of the present invention.

Hereinafter, one embodiment of the present invention will be described with reference to FIG. 1 to FIG. 5. A drying booth 10 shown in FIG. 1 extends along a direction perpendicular to the paper face (hereinafter referred to as "front-back direction"), its interior being a drying chamber 29 according to the present invention. The drying booth 10 is equipped with a transfer rail 14 extending in the front-back direction on a bottom surface 12 at the center in the width direction. An object to be dried 90, for example, a car body that has just been electropainted, is carried on a transfer carriage 15 that moves on the transfer rail 14, and transferred into and out of the drying chamber 29. The drying booth 10 has a length just enough to accommodate one car body that is the object to be dried 90, and includes an entrance/exit with a door (not shown) at one end thereof.

The drying booth 10 has a cross-sectional shape that is quadrilateral with both upper corners obliquely cut away, conforming to the contour of the car body that is the object to be dried 90 as viewed in the front-back direction.

The drying booth 10 is equipped with a pair of air supply ducts 16, 16 extending in the front-back direction on both sides of the transfer rail 14. The air supply duct 16 on the right side in FIG. 1 overlaps a bottom surface 12 and an inner-side surface of the drying booth 10, and faces the transfer rail 14 with a gap. This air supply duct 16 has an upper wall surface that is made up of a first horizontal part 17 from the left end in FIG. 1 to a substantially central position in the width direction, a concave curved part 18 from the substantially central position to a point close to the right end, gradually rising up toward the right side, and a second horizontal part 19 from the point close to the right end to the right end. More specifically, the concave curved part 18 is made up of a first slope 18A rising up from the first horizontal part 17 at an angle of about 30°, a second slope 18B upright from an upper end portion of the first slope 18A at an angle of about 60° with respect to the horizontal direction, and a vertical part 18C upright vertically from an upper end portion of the second slope 18B.

The air supply duct 16 on the left side in FIG. 1, on the other hand, is in a shape identical to substantially the upper half of the right-side air supply duct 16 and placed on an exhaust duct 20. The cross-sectional contour of both the left-side air supply duct 16 and the exhaust duct 20, and the cross-sectional contour of the right-side air supply duct 16, are bilaterally symmetric.

The exhaust duct 20 is formed with a plurality of slits 20S in a surface facing the transfer rail 14, for example. A plurality of nozzles 30 are attached to the concave curved part 18 of each air supply duct 16. An exhaust relay duct 21 extending through a side wall of the drying booth 10 is connected to the exhaust duct 20, and an air supply relay duct 22 extending through a side wall of the drying booth 10 is connected to each of the air supply ducts 16, 16. The exhaust relay duct 21 and the air supply relay duct 22 are connected to each other via a heating device 24 and a feeding device 25, a drying system 39 according to the present invention thus being configured. The feeding device 25 feeds air from the exhaust relay duct 21 to the air supply relay duct 22, and this supplied air is heated by the heating device 24. Thus the air inside the drying chamber 29 is sucked into the exhaust duct 20 through the slits 20S, and as the air passes through the exhaust relay duct 21 and air supply relay duct 22, the air is heated by the heating device 24 and fed to each air supply duct 16. The air inside the air supply ducts 16 is then blown out as hot air into the drying chamber 29 from the plurality of nozzles 30.

Figure 2:
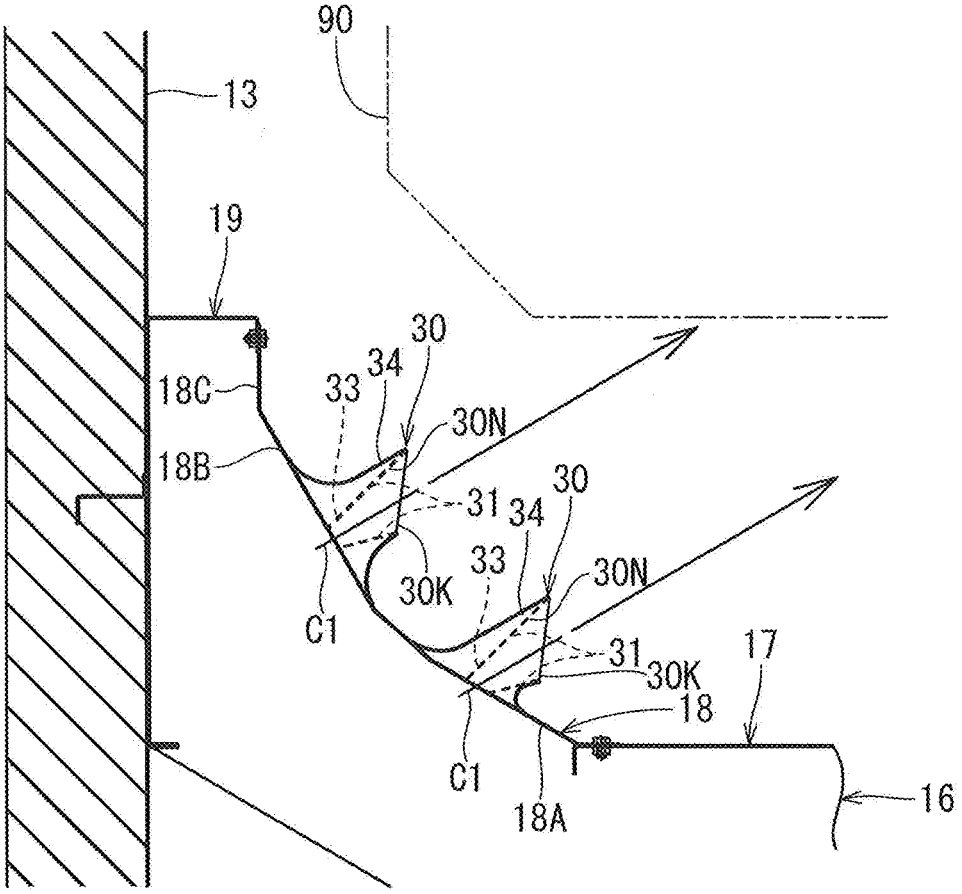
FIG. 2 is a side view of a nozzle attached to an air supply duct.
Figure 3:
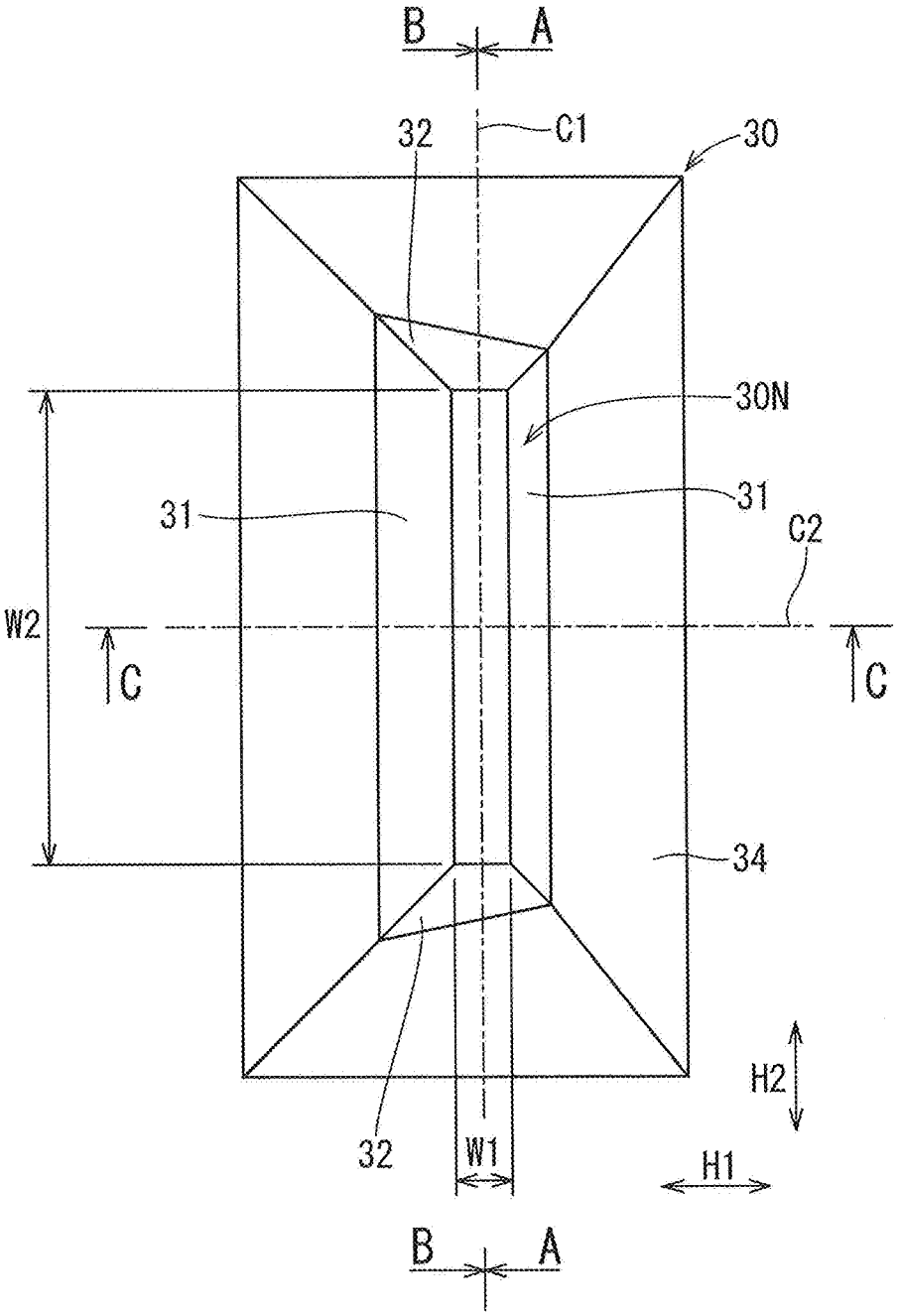
FIG. 3 is a plan view of the nozzle.

As shown in FIG. 2, the plurality of nozzles 30 are aligned along the longitudinal direction (perpendicular to the paper face of FIG. 2) of the first slope 18A and the second slope 18B of each air supply duct 16. Each nozzle 30 has a horn-shaped inner-side surface 30N that gradually spreads toward the distal end, and its opening is rectangular that is long along a second direction H2, which is the longitudinal direction of the air supply duct 16, as shown in FIG. 3.

More specifically, the inner-side surface 30N of the nozzle 30 is made up of a pair of second inner-side surfaces 32, 32 facing each other in the second direction H2 mentioned above, and a pair of first inner-side surfaces 31, 31 facing each other in a first direction H1 perpendicular to the second direction H2. The opening of the nozzle 30 has an opening width W2 in the second direction H2 that is 2 to 25 times inclusive larger than the opening width W1 in the first direction H1, in any cross section perpendicular to both of a first center plane C1 positioned at the center between the first inner-side surfaces 31, 31 and a second center plane C2 positioned at the center between the second inner-side surfaces 32, 32. The first inner-side surfaces 31, 31 make an opening angle of more than 0° and 45° or less, and the second inner-side surfaces 32, 32 make an opening angle of 5° to 45° inclusive, these opening angles more preferably being 10° to 20° inclusive. In this embodiment, the first inner-side surfaces 31, 31 and the second inner-side surfaces 32, 32 make the same opening angle of, for example, 5° to 45° inclusive. The opening angle between the first inner-side surfaces 31, 31 may be 0°.

As shown in FIG. 2, each nozzle 30 is attached to an outer face of the air supply duct 16 such that the first center plane C1 is inclined to the horizontal plane in an angle of 15° to 45° inclusive. An opening plane 30K at the distal end of the nozzle 30 is perpendicular to the second center plane C2 (see FIG. 4(A) and FIG. 4(B)), while intersecting the first center plane C1 (see FIG. 5) obliquely. The opening plane 30K is slightly slanted with respect to the up and down direction so that the lower opening edge at the distal end of the nozzle 30 is slightly shifted toward the proximal end of the nozzle 30 from the point vertically below the upper opening edge. Alternatively, the opening plane 30K may be parallel to the vertical direction so that the lower opening edge at the distal end of the nozzle 30 is positioned vertically below the upper opening edge.

Figure 4A:
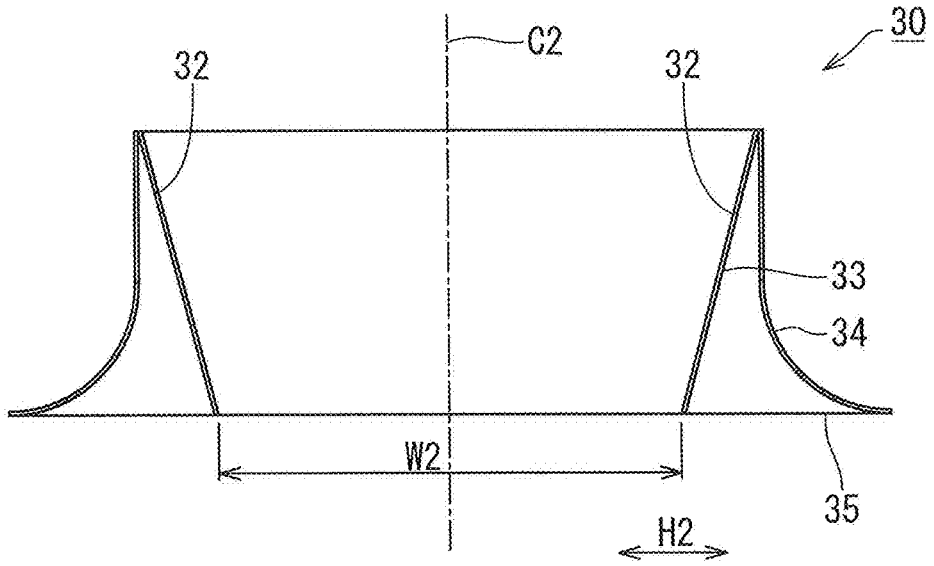
FIG. 4(A) is a cross-sectional view of section A-A of the nozzle of FIG. 3.
Figure 4B:
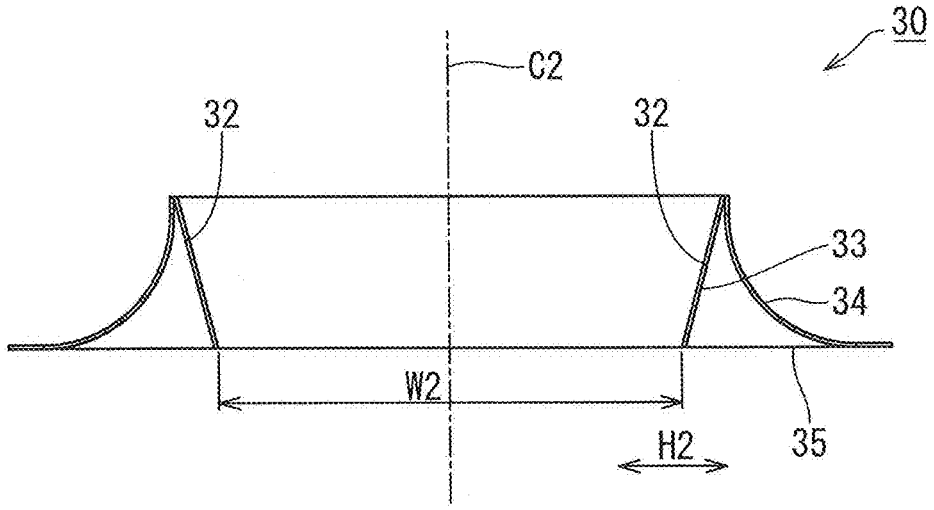
FIG. 4(B) is a cross-sectional view of section B-B of the nozzle of FIG. 3.
Figure 5:
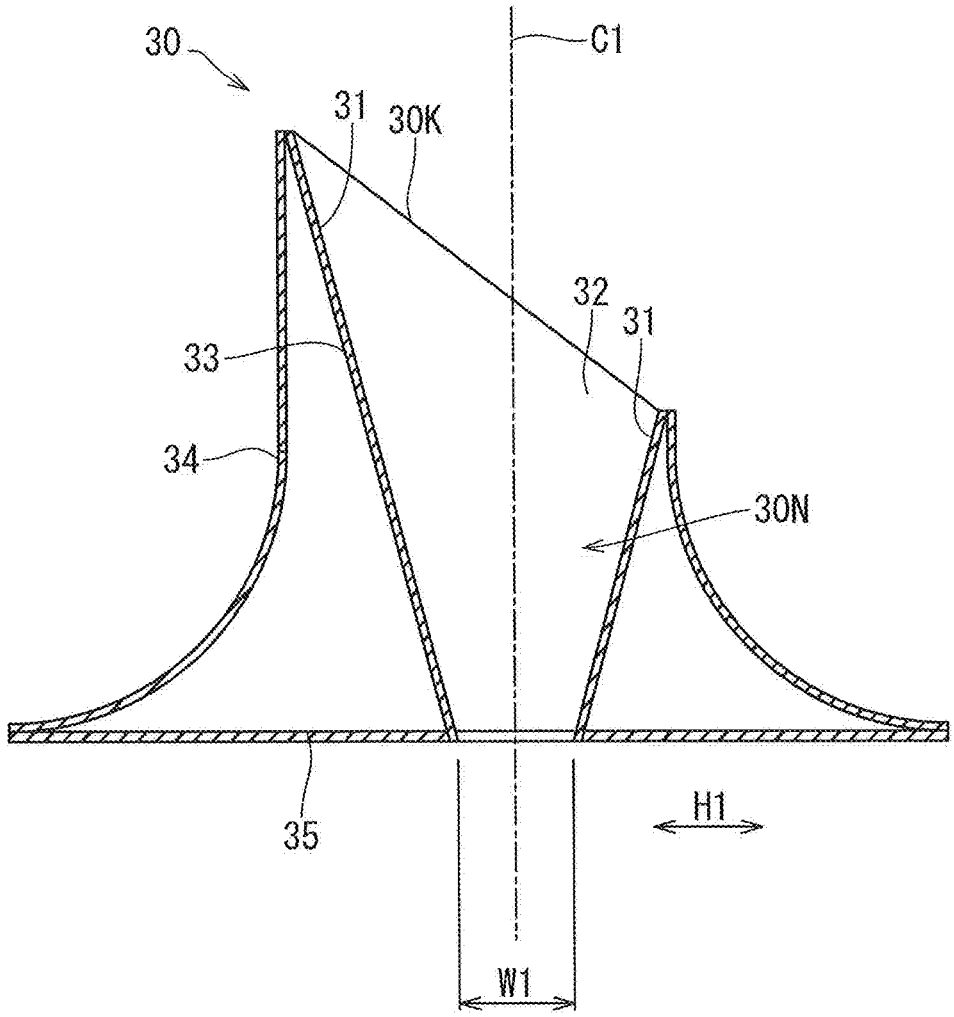
FIG. 5 is a cross-sectional view of section C-C of the nozzle of FIG. 3.

As shown in FIG. 4 and FIG. 5, the nozzle 30 is composed of an inner tubular member 33, an outer tubular member 34, and a fixed flange 35 made from sheet metal and assembled together, for example. The inner tubular member 33 has a horn shape, its inner surface being the horn-shaped inner-side surface 30N that has been described previously. The fixed flange 35 has a rectangular planar shape, with a rectangular opening in the center to which a proximal end of the inner tubular member 33 is fitted. One end of the outer tubular member 34 is fitted to the outer side of the distal end of the inner tubular member 33 and welded thereto, and the other end is welded to the fixed flange 35 at a point laterally spaced from the inner tubular member 33. Each side surface of the outer tubular member 34 is concavely curved. The joint angle between adjacent side surfaces of the outer tubular member 34 in a portion fitted with the distal end of the inner tubular member 33 is 90°, the joint angle between adjacent side surfaces gradually increasing toward the fixed flange 35, and becoming substantially 0° in a portion joined to the fixed flange 35.

The configuration of the drying booth 10 equipped with the nozzle 30 according to this embodiment is as has been described above. Next, the effects of this drying booth 10 will be explained. When the drying system 39 shown in FIG. 1 is activated, as mentioned before, the air inside the drying chamber 29 is sucked into the exhaust duct 20, and as the air passes through the exhaust relay duct 21 and air supply relay duct 22, it is heated by the heating device 24 and fed to each air supply duct 16. The air is then blown out as hot air from the plurality of nozzles 30 of each air supply duct 16 into the drying chamber 29. The temperature of the air inside the drying chamber 29 thus rises gradually, which reduces the humidity gradually.

When the temperature inside the drying chamber 29 reaches or exceeds a predetermined level, the entrance/exit door (not shown) is opened to carry in an object to be dried 90 into the drying chamber 29, and the entrance/exit door is then closed. The object to be dried 90 is positioned above the plurality of nozzles 30, and starts to be heated with hot air blown out from the nozzles 30 to the lower surface. Here, as will be verified by simulation to be described later, the hot air blown out from the nozzles 30 spreads more widely in the first direction H1, along which the nozzle has a smaller opening width, than in the second direction H2, along which the nozzle opens wider. The hot air spreads at a larger angle than the opening angle between the first inner-side surfaces 31, 31 in the first direction H1 immediately after being blown out of the nozzles 30.

With the nozzle 30 of this embodiment having a structure wherein the opening plane 30K is inclined with respect to the first center plane C1 between the first inner-side surfaces 31, 31, the hot air spreads widely outside the first inner-side surface 31 on the side where it extends largely forward (upper side in FIG. 2). That is, the hot air spreads above the nozzle 30. The hot air that has spread immediately after being blown from the nozzle 30 draws in the air of a wide area surrounding the nozzle 30 and is blown toward the object to be dried 90.

This way, hot air can be blown to a wider area of the object to be dried 90 nearer to the nozzle 30 than with conventional nozzles. Since the nozzles 30 can be placed closer to the object to be dried 90, the drying chamber 29 can be made smaller. Moreover, since the nozzles 30 blow out hot air upward, the heated air goes up smoothly in the drying chamber 29 so that the temperature above the object to be dried 90 can be raised quickly, too. In this way, the entire object to be dried 90 can be efficiently heated, and efficiently dried.

Moreover, since the lower opening edge of the opening at the distal end of the nozzle 30 is offset toward the proximal end relative to the upper opening edge, any liquid dropping from the object to be dried 90 does not enter the nozzle 30. Furthermore, the dust proof shape of the nozzle 30, with its outer surface being covered by the outer tubular member 34, allows for efficient cleaning.

Second Embodiment

Figure 6:
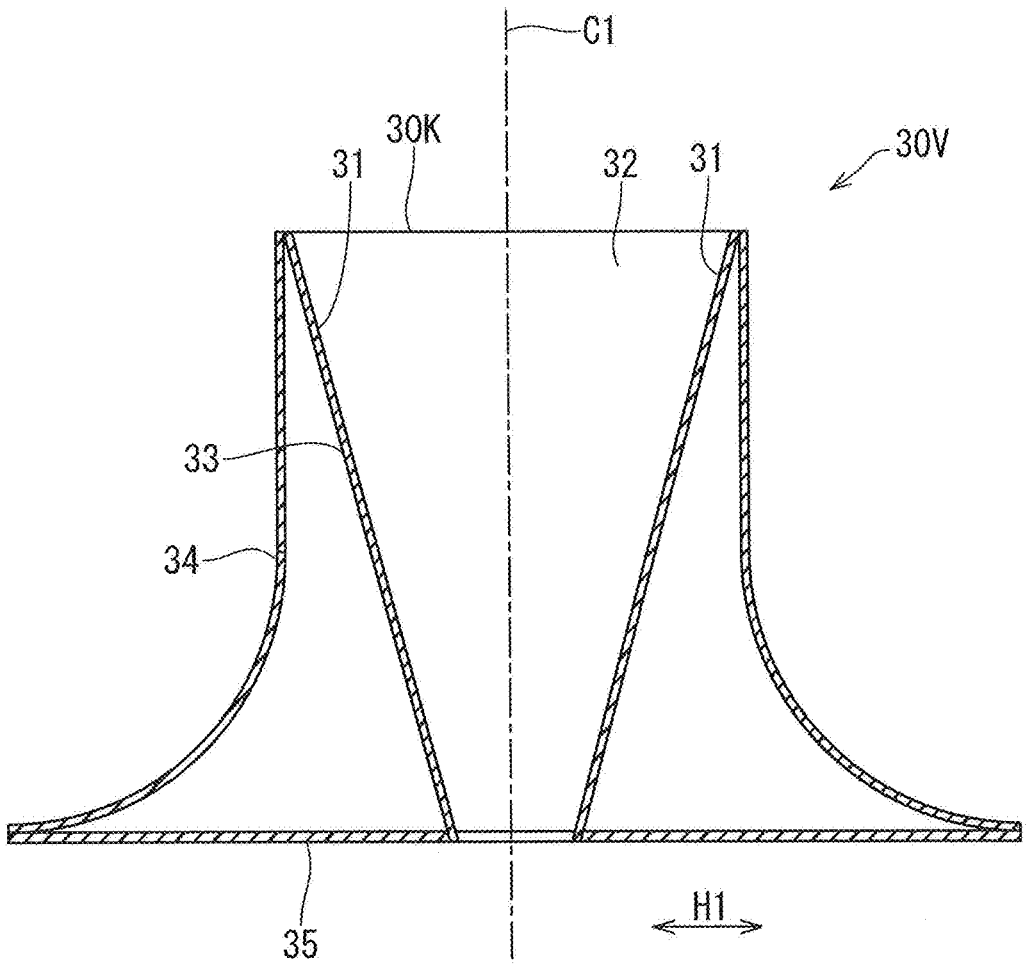
FIG. 6 is a cross-sectional view of a nozzle according to a second embodiment.

FIG. 6 shows a nozzle 30V according to this embodiment, which is different from the first embodiment only in that the opening plane 30K of the nozzle 30V of this embodiment is perpendicular to the first center plane C1, as opposed to the opening plane 30K of the nozzle 30 being inclined to the first center plane C1. With the nozzle 30V having such a configuration, hot air can be blown to a wider area of the object to be dried 90 nearer to the nozzle 30V, as compared to conventional nozzles.

EXAMPLES

Simulation analysis and measurement tests were conducted to ascertain the effectiveness of the present invention.

1. Simulation Analysis (A) Using a fluid analysis simulator, the statuses of the hot air blown out from nozzle products G1 and G2 according to the invention and comparative nozzle products N1 and N2 attached to the air supply duct were analyzed. The opening sizes specified in (1) Varied conditions below are the opening sizes at the proximal ends of the nozzles. Product G1 of the invention corresponds to the nozzle 30 of the first embodiment described above, and Product G2 of the invention corresponds to the nozzle 30V of the second embodiment.

A. Experimental Conditions (1) Varied Conditions

Product G1 of the invention: Opening 10×125 [mm]; opening angle 15°; length 75 [mm]; square conical tube with slanted opening plane Product G2 of the invention: Opening 10×125 [mm]; opening angle 15°; length 75 [mm]; square conical tube Comparative Product N1: Opening 10×125 [mm]; opening angle 0°; length 75 [mm]; square tube Comparative Product N2: Opening diameter 40 [mm]; opening angle 15°; length 75 [mm]; conical tube (2) Fixed Conditions Temperature of air inside the air supply ducts: 11° C.

Volume of air blown from the air supply ducts: 68 $m^3/h$

B. Experimental Results

Figure 7A:
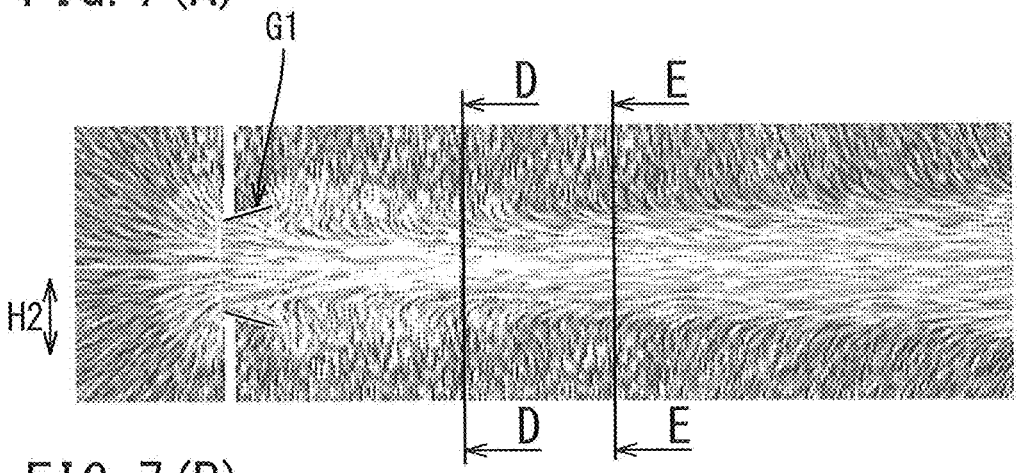
FIG. 7 shows simulation results of Product G1 according to the invention in Example.
Figure 7B:
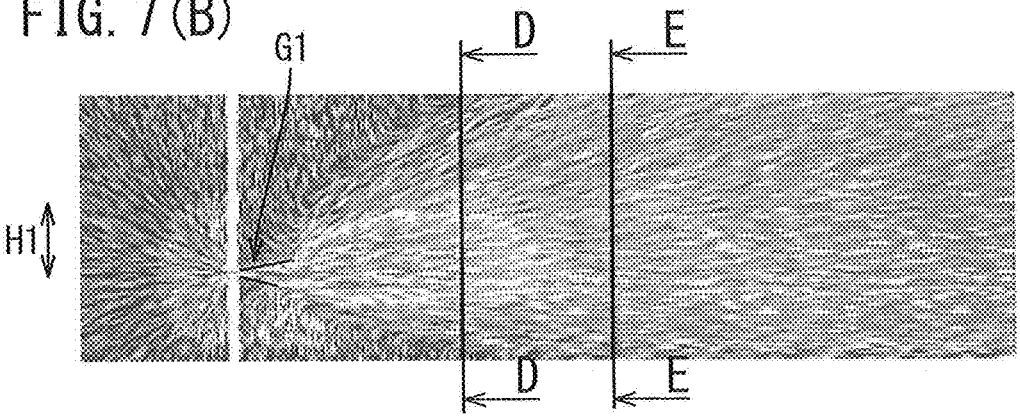
Figure 7C:
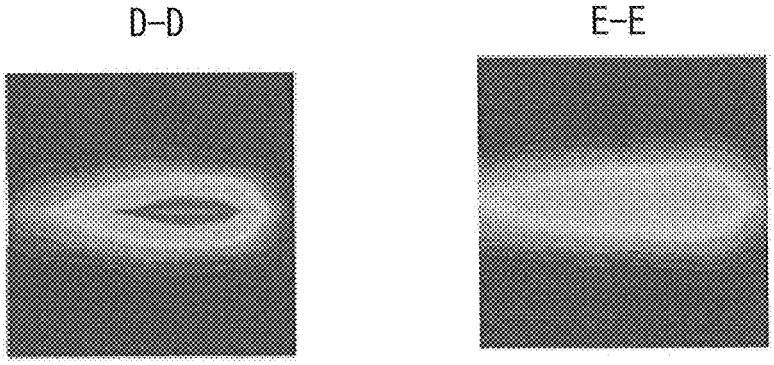

FIG. 7(A) shows how the hot air from Product G1 of the invention spreads in a cross section of Product G1 parallel to the first center plane C1 (cross section of FIG. 4(A)), and FIG. 7(B) shows how the hot air from Product G1 of the invention spreads in a cross section parallel to the second center plane C2 (cross section of FIG. 5). FIG. 7(C) shows how the hot air spreads in section D-D and section E-E of FIG. 7(A). Similarly to FIG. 7, FIG. 8 shows how the hot air spreads from Product G2 of the invention, FIG. 9 shows how the hot air spreads from Comparative Product N1, and FIG. 10 shows how the hot air spreads from Comparative Product N2.

Figure 8A:
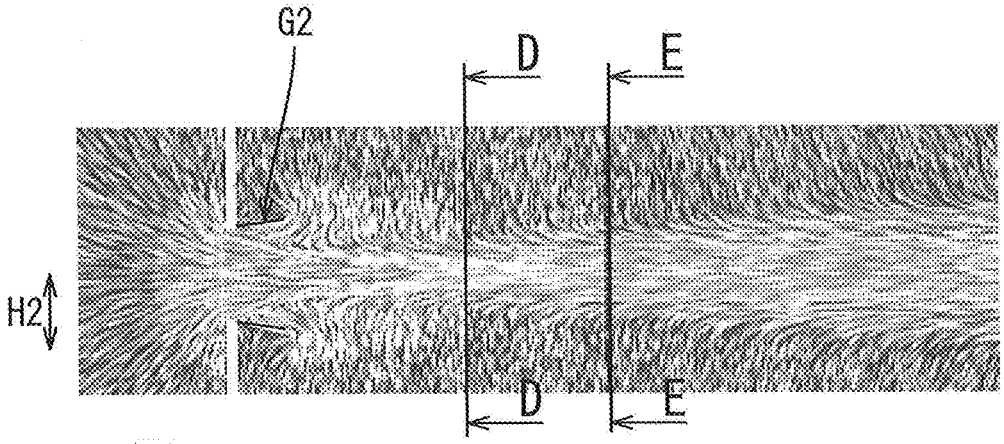
FIG. 8 shows simulation results of Product G2 according to the invention.
Figure 8B:
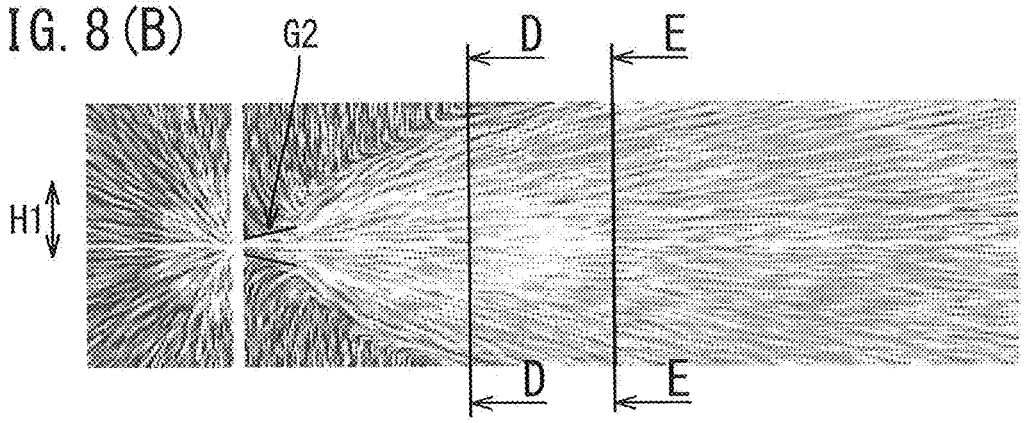
Figure 8C:
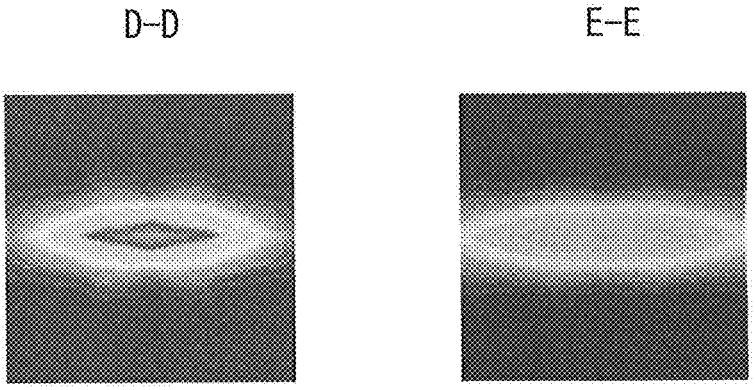

From a comparison between FIG. 8(A) and FIG. 8(B) and a comparison in size between horizontal and vertical directions of FIG. 8(C), it can be seen that the hot air blown out from Product G2 of the invention, which is the nozzle 30V of the second embodiment, spreads more largely in the first direction H1, along which the nozzle has a smaller opening width, than in the second direction H2, along which the nozzle opens wider. From FIG. 11(A) that is an enlarged view of a part of FIG. 8(B), it can also be seen that the hot air spreads at a larger angle than the opening angle between the first inner-side surfaces 31, 31 in the first direction H1 immediately after being blown out of Product G2 of the invention. It is also discernible that the air near Product G2 of the invention is drawn by the hot air blown out from Product G2 of the invention.

Figure 11:
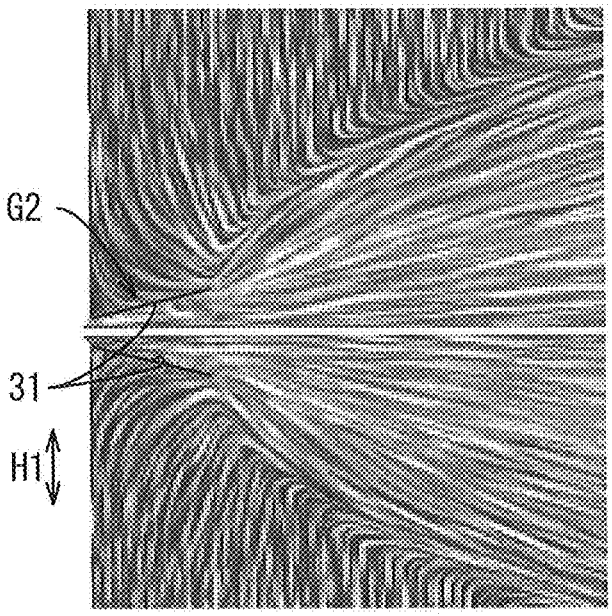
FIG. 11(A) shows simulation results of Product G2 of the invention, and (B) shows simulation results of Product G1 of the invention.
Figure 11:
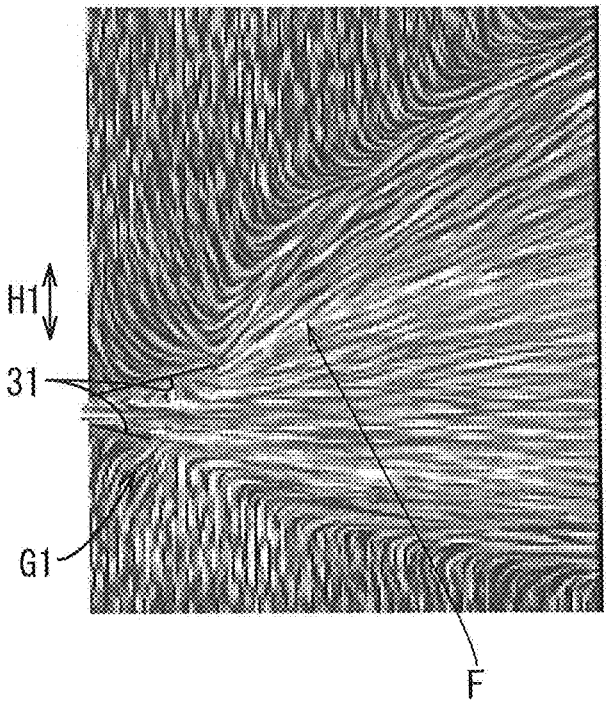

From FIG. 7 and FIG. 11(B), it can be seen that the same applies to the hot air blown out from Product G1 of the invention, which is the nozzle 30 of the first embodiment, as with Product G2 of the invention. It can be seen in addition that, as shown by arrow F in FIG. 11(B), the hot air from Product G1 of the invention spreads widely outside the first inner-side surface 31 on the side where it extends largely forward.

Figure 9A:
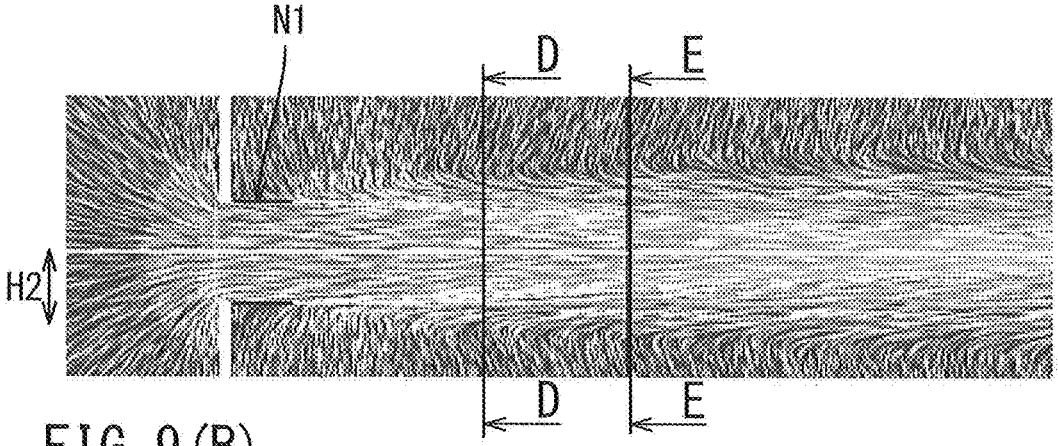
FIG. 9 shows simulation results of Comparative Product N1.
Figure 9B:
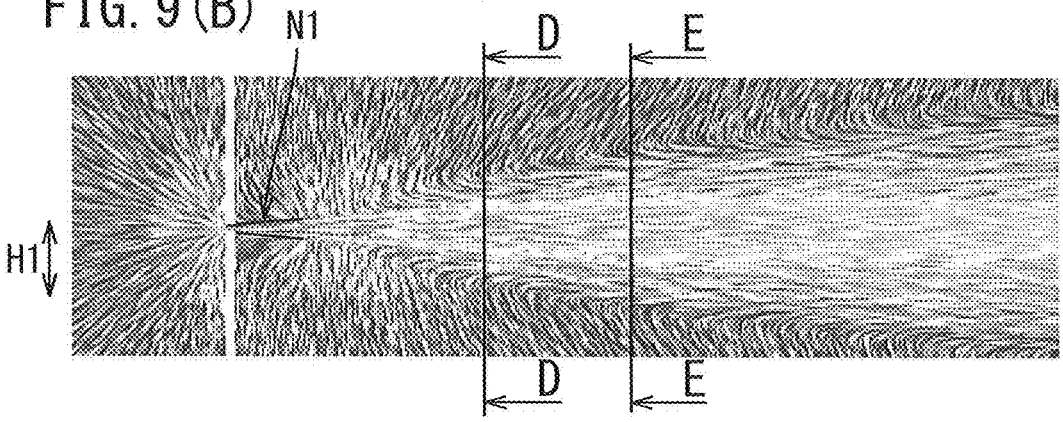
Figure 9C:
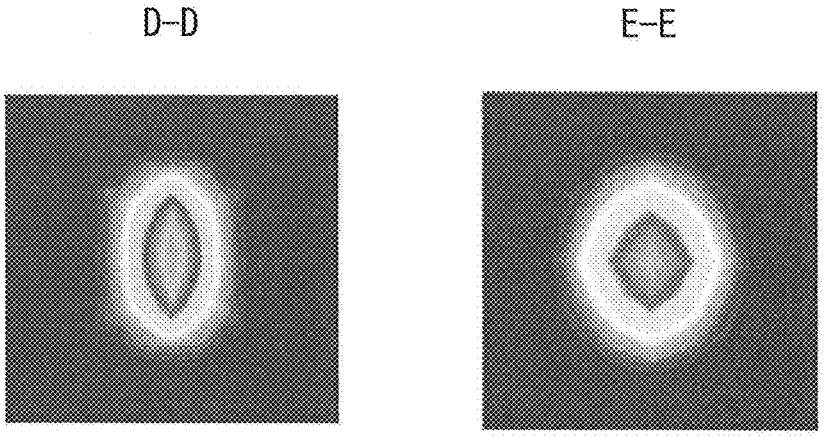
Figure 10A:
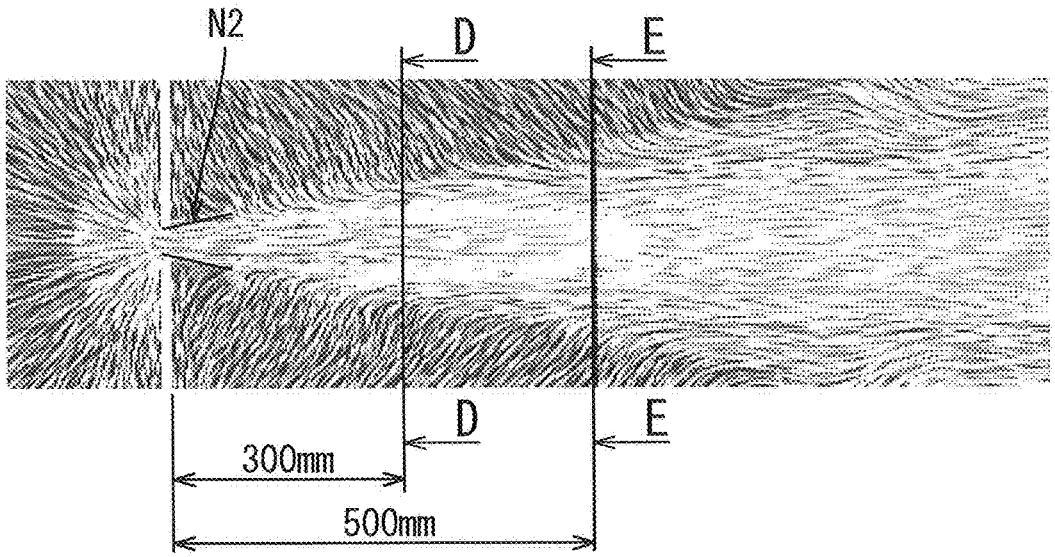
FIG. 10 shows simulation results of Comparative Product N2.
Figure 10B:
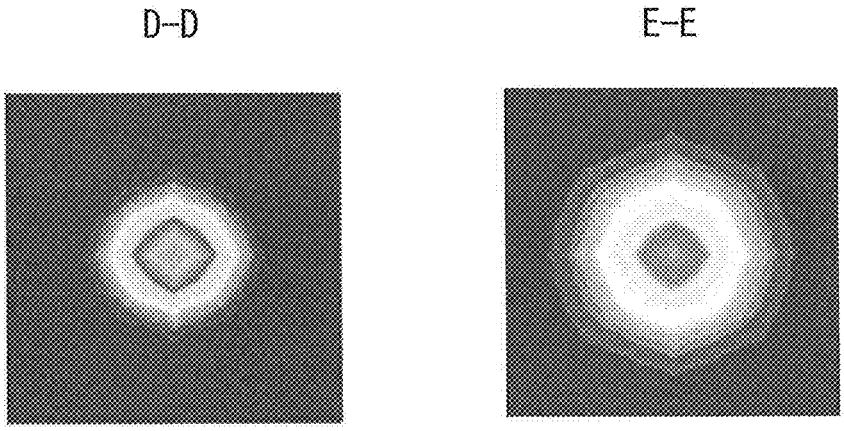

From FIG. 9, it can be seen that hot air from Comparative Product N1, which corresponds to the nozzle 30V of the second embodiment but has an opening angle of 0°, spreads wider at a point near the nozzle in the second direction H2, along which the opening width is larger, than in the first direction H1, along which the opening width is smaller, and that this is inverted at a point far away from the nozzle. From FIG. 10, it can be seen that hot air from the conical Comparative Product N2 spreads gradually sideways as it flows away from the nozzle. From these results, it can be said that hot air spreads sideways nearer to the nozzles with Products G1 and G2 of the invention as compared to Comparative Products N1 and N2, so that the hot air can be blown to a wider area of the object to be dried.

Figure 12A:
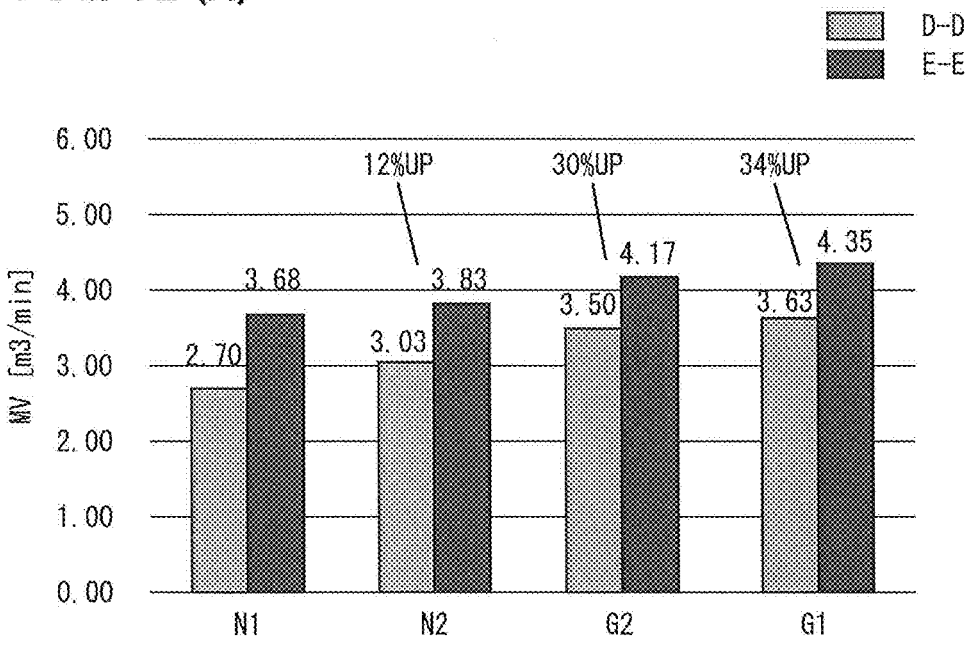
FIG. 12(A) is a graph comparing air volumes between comparative products and products according to the invention, and (B) is a graph comparing air speeds between comparative products and products according to the invention.
Figure 12B:
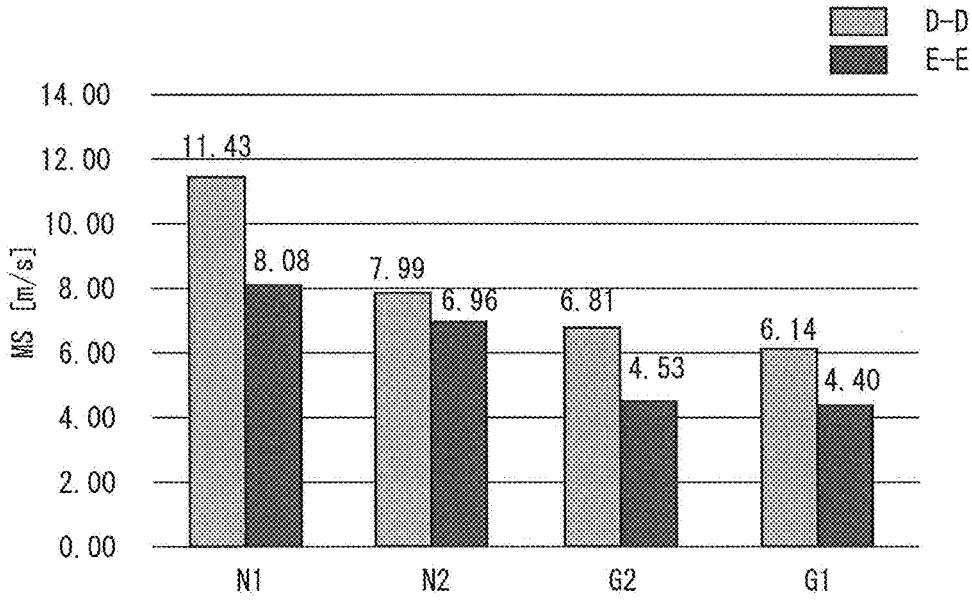

FIG. 12 shows a comparison between Products G1 and G2 of the invention and Comparative Products N1 and N2 of the volume MV and maximum speed MS of the ejected hot air that has reached the section D-D and section E-E near the nozzles. The figure indicates that the hot air from Products G1 and G2 of the invention arrives at the points near the nozzles with a lower maximum speed MS and in a larger volume MV as compared to Comparative Products N1 and N2. This means that, with Products G1 and G2 of the invention, the ejected hot air imparts part of its momentum to the air near the nozzle and draws the air, so that a larger volume of hot air is directed to the object to be dried at a milder speed. These results indicate that the drying system that uses the nozzle products G1 and G2 of the present invention is capable of efficiently heating and efficiently drying the entire object to be dried.

2. Measurement Test

Figure 13A:
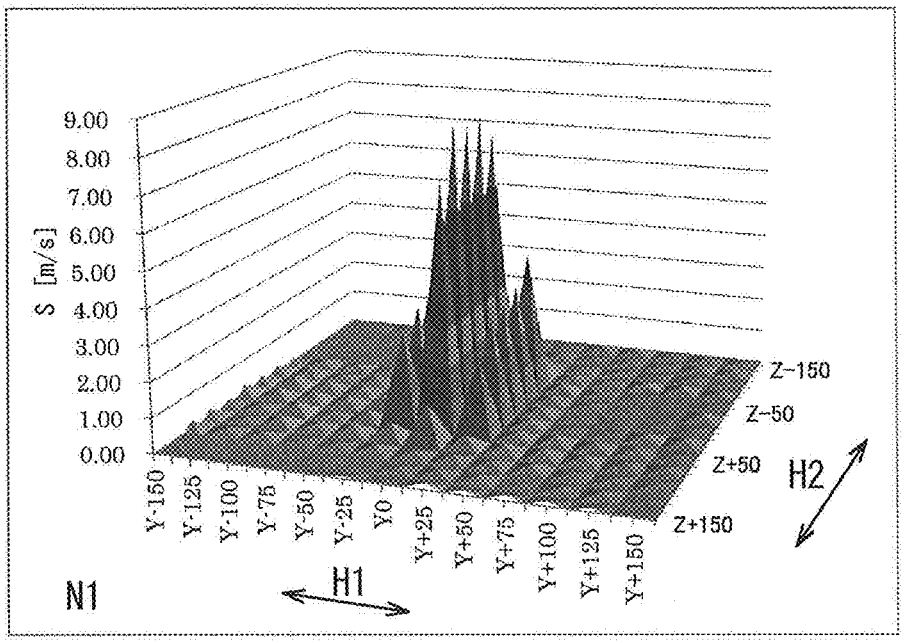
FIG. 13(A) is a distribution graph of the air speeds measured with Comparative Product N1, and (B) is a distribution graph of the air speeds measured with Product G2 of the invention.
Figure 13B:
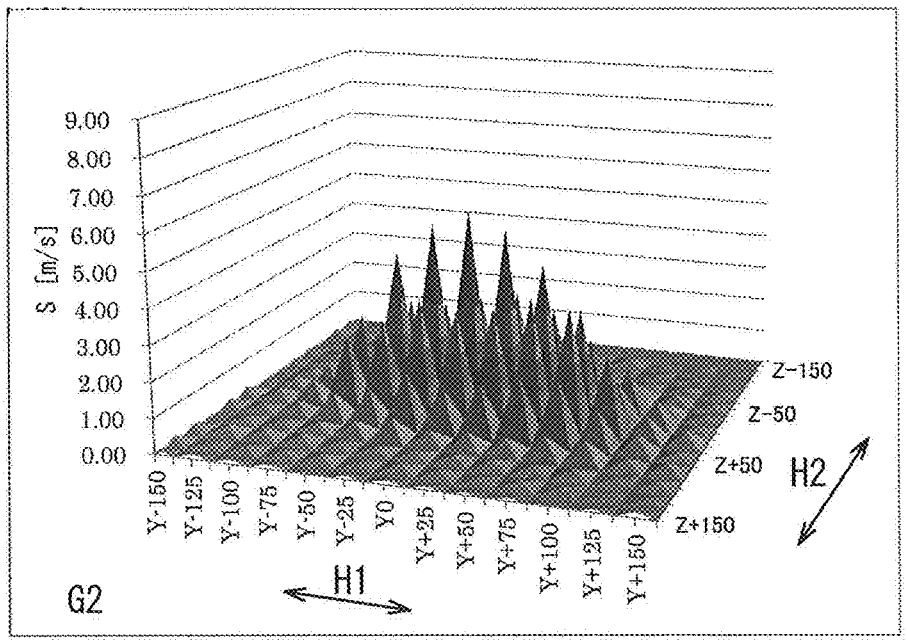

To confirm the results of the simulation analysis described above with actual measurements, Product G2 of the invention and Comparative Product N1 were made, and air speed S was measured with an air speed sensor set at a position corresponding to the section D-D mentioned above. FIG. 13 shows the measurement results in graphs. From the measurement results, it was found that the hot air blown out from Product G2 of the invention spread more largely in the first direction H1, along which the nozzle has a smaller opening width, than in the second direction H2, along which the nozzle opens wider, similarly to the simulation analysis described above, and this was inverted with Comparative Product N1. It was also found that Product G2 of the invention could direct a larger volume of hot air toward the object to be dried at a milder speed as compared to Comparative Product N1.

Other Embodiments

The present invention is not limited to the embodiments described above and can be carried out in other ways with various changes made without departing from the scope of the subject matter.

DESCRIPTION OF THE REFERENCE NUMERAL

16 Air supply duct
24 Heating device
25 Feeding device
29 Drying chamber
30, 30V Nozzle
30K Opening plane
30N Horn-shaped inner-side surface
31 First inner-side surface
32 Second inner-side surface
33 Inner tubular member
34 Outer tubular member
35 Fixed flange
39 Drying system
90 Object to be dried
C1 First center plane
C2 Second center plane
H1 First direction
H2 Second direction

The invention claimed is:

1. A drying system comprising:

a nozzle attached to an air supply duct of a drying chamber that blows out heated air inside the air supply duct toward an object to be dried inside the drying chamber, the nozzle including: a horn-shaped inner-side surface made up of a pair of first inner-side surfaces facing each other in a first direction, and a pair of second inner-side surfaces facing each other in a second direction perpendicular to the first direction, with an opening width at least in the second direction gradually increasing forward in a direction in which the air is blown, the opening width in the second direction being 2 to 25 times inclusive larger than an opening width in the first direction;

the air supply duct including a plurality of the nozzles;

a feeding device that feeds air to the air supply duct; and a heating device that heats air fed to the air supply duct, wherein the feeding device feeds air to the air supply duct in such a flow volume that the air blown out from the nozzle spreads more in the first direction than in the second direction.

2. A drying system comprising:

a nozzle attached to an air supply duct of a drying chamber that blows out heated air inside the air supply duct toward an object to be dried inside the drying chamber, the nozzle including: a horn-shaped inner-side surface made up of a pair of first inner-side surfaces facing each other in a first direction, and a pair of second inner-side surfaces facing each other in a second direction perpendicular to the first direction, with an opening width at least in the second direction gradually increasing forward in a direction in which the air is blown, the opening width in the second direction being 2 to 25 times inclusive larger than an opening width in the first direction;

the air supply duct including a plurality of the nozzles;

a feeding device that feeds air to the air supply duct; and a heating device that heats air fed to the air supply duct, wherein the first inner-side surfaces of the nozzle make an opening angle of more than 0° and 45° or less, and the second inner-side surfaces make an opening angle of 5° to 45° inclusive, and wherein the feeding device feeds air to the air supply duct in such a flow volume that the air blown out from the nozzle spreads more in the first direction than in the second direction.

3. A drying system comprising:

a nozzle attached to an air supply duct of a drying chamber that blows out heated air inside the air supply duct toward an object to be dried inside the drying chamber, the nozzle including: a horn-shaped inner-side surface made up of a pair of first inner-side surfaces facing each other in a first direction, and a pair of second inner-side surfaces facing each other in a second direction perpendicular to the first direction, with an opening width at least in the second direction gradually increasing forward in a direction in which the air is blown, the opening width in the second direction being 2 to 25 times inclusive larger than an opening width in the first direction;

the air supply duct including a plurality of the nozzles;

a feeding device that feeds air to the air supply duct; and a heating device that heats air fed to the air supply duct, wherein the nozzle further includes an inner tubular member having a horn shape and having the horn-shaped inner-side surface; a fixed flange extending sideways from a proximal end of the inner tubular member with a smaller opening, and overlapped on and fixed to an outer surface of the air supply duct; and an outer tubular member having one end fitted with a distal end of the inner tubular member and another end joined to the fixed flange at a point laterally spaced from the inner tubular member, and wherein the feeding device feeds air to the air supply duct in such a flow volume that the air blown out from the nozzle spreads more in the first direction than in the second direction.

4. The drying system according to claim 1, wherein at least one of the plurality of nozzles is placed below an object to be dried, the nozzle placed below the object to be dried is oriented such that the pair of first inner-side surfaces face each other in an up and down direction and that an imaginary first center plane positioned at a center between the first inner-side surfaces is directed upward toward a distal end of the nozzle, and the nozzle has an opening plane at the distal end that is substantially parallel to a vertical direction, a lower opening edge at the distal end of the nozzle being positioned vertically below an upper opening edge or shifted toward a proximal end of the nozzle from a point vertically below the upper opening edge.

5. The drying system according to claim 2, wherein at least one of the plurality of nozzles is placed below an object to be dried, the nozzle placed below the object to be dried is oriented such that the pair of first inner-side surfaces face each other in an up and down direction and that an imaginary first center plane positioned at a center between the first inner-side surfaces is directed upward toward a distal end of the nozzle, and the nozzle has an opening plane at the distal end that is substantially parallel to a vertical direction, a lower opening edge at the distal end of the nozzle being positioned vertically below an upper opening edge or shifted toward a proximal end of the nozzle from a point vertically below the upper opening edge.

6. The drying system according to claim 3, wherein at least one of the plurality of nozzles is placed below an object to be dried, the nozzle placed below the object to be dried is oriented such that the pair of first inner-side surfaces face each other in an up and down direction and that an imaginary first center plane positioned at a center between the first inner-side surfaces is directed upward toward a distal end of the nozzle, and the nozzle has an opening plane at the distal end that is substantially parallel to a vertical direction, a lower opening edge at the distal end of the nozzle being positioned vertically below an upper opening edge or shifted toward a proximal end of the nozzle from a point vertically below the upper opening edge.

* * * * *